US007975987B2

(12) United States Patent
Shin

(10) Patent No.: US 7,975,987 B2
(45) Date of Patent: Jul. 12, 2011

(54) WIRE-TWISTING PREVENTION DEVICE OF LIFTING REEL WITH FOUR-LINE WIRE STRUCTURE AND LIFTING REEL HAVING THE SAME

(76) Inventor: Jeong-Hun Shin, Suncheon-si (KR)

( * ) Notice: Subject to any disclaimer, the term of this patent is extended or adjusted under 35 U.S.C. 154(b) by 236 days.

(21) Appl. No.: 12/374,890

(22) PCT Filed: Jul. 25, 2007

(86) PCT No.: PCT/KR2007/003561

§ 371 (c)(1),
(2), (4) Date: Jan. 23, 2009

(87) PCT Pub. No.: WO2008/013397

PCT Pub. Date: Jan. 31, 2008

(65) Prior Publication Data

US 2009/0200444 A1 Aug. 13, 2009

(30) Foreign Application Priority Data

Jul. 25, 2006 (KR) ..... 10-2006-0069529

(51) Int. Cl.
*B66D 1/26* (2006.01)

(52) U.S. Cl. ..... 254/278; 254/285; 254/286; 254/290; 212/83

(58) Field of Classification Search ..... 254/278, 254/283–286, 290, 371; 212/274, 71, 83, 212/84, 330
See application file for complete search history.

(56) References Cited

U.S. PATENT DOCUMENTS

| | | | | | |
|---|---|---|---|---|---|
| 3,210,114 | A | * | 10/1965 | Lawton | 294/81.4 |
| 3,887,080 | A | * | 6/1975 | Wilson | 212/318 |
| 4,905,848 | A | * | 3/1990 | Skjonberg | 212/274 |
| 4,949,854 | A | | 8/1990 | Foit | |
| 4,949,855 | A | * | 8/1990 | Foit | 212/274 |
| 5,114,025 | A | * | 5/1992 | Verreet | 212/274 |
| 5,765,703 | A | * | 6/1998 | Shiwaku | 212/274 |
| 6,102,372 | A | * | 8/2000 | Gersemsky et al. | 254/278 |
| 6,135,301 | A | | 10/2000 | Monzen et al. | |
| 7,284,744 | B1 | * | 10/2007 | Lerchenmueller et al. | 254/278 |
| 7,287,740 | B2 | * | 10/2007 | Reyes et al. | 254/278 |
| 2004/0069734 | A1 | * | 4/2004 | Hakala | 212/274 |

FOREIGN PATENT DOCUMENTS

JP 200 0-198666 7/2000

* cited by examiner

*Primary Examiner* — Emmanuel M Marcelo
(74) *Attorney, Agent, or Firm* — Husch Blackwell LLP

(57) ABSTRACT

A lifting reel with a four-line wire structure includes a fixed body fixed to a ceiling of a structure, first and second drums installed to the body at a predetermined interval and rotated by a driving motor, wires respectively connected to the first and second drums, and first, second, third and fourth guide rollers arranged on a top of a lifting body at regular intervals and suspended on the wires to form a four-line wire. A wire-twisting prevention device is installed between an end of the wire connected to the first drum and an end of the wire connected to the second drum so as to connect both wires with each other. The wire-twisting prevention device includes bearings installed to the ends of the wires to be rotatable, respectively. The bearings prevent the wires from being twisted while the wires are wound around or unwound from the drums.

8 Claims, 3 Drawing Sheets

[Fig. 1]
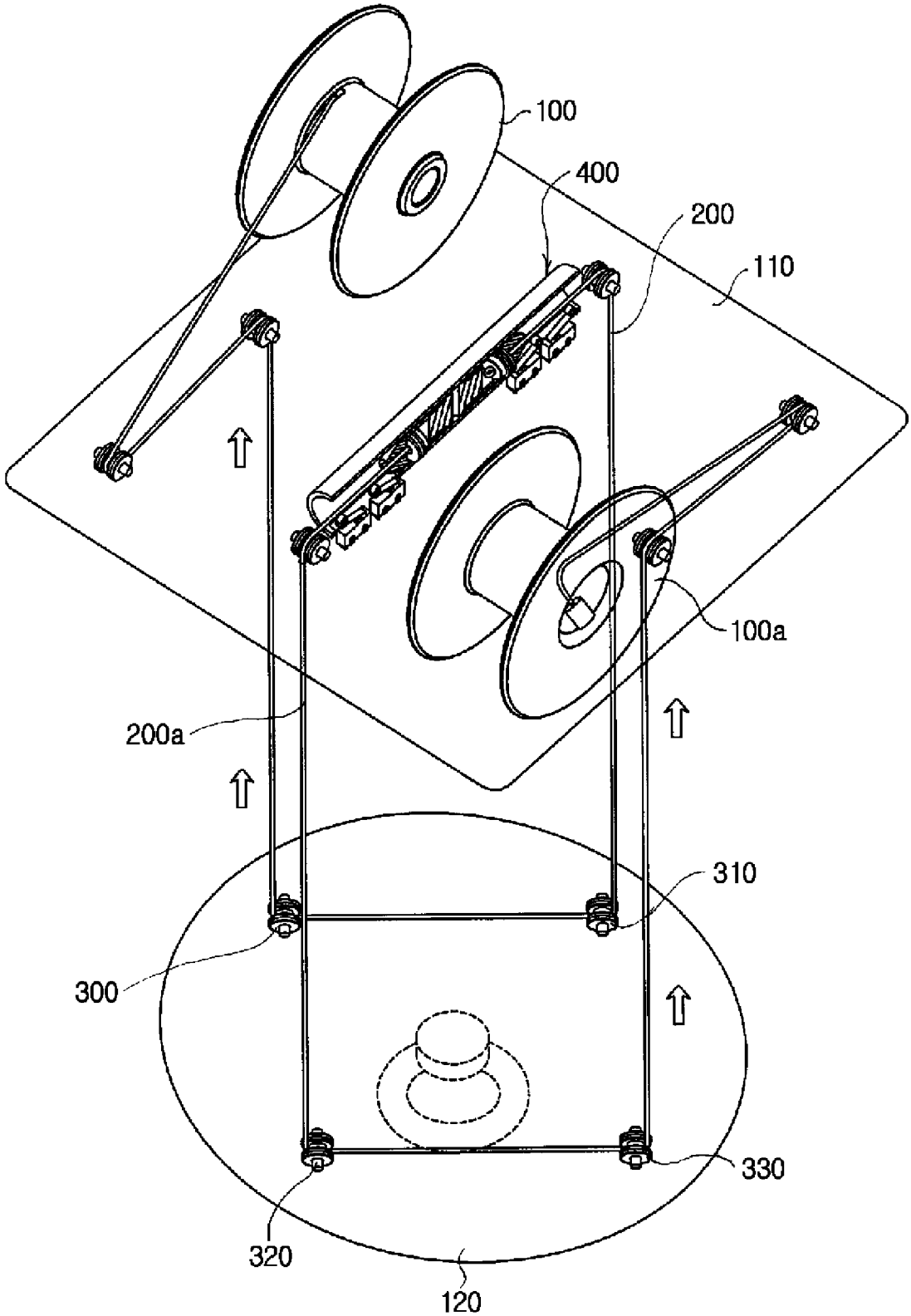

[Fig. 2]
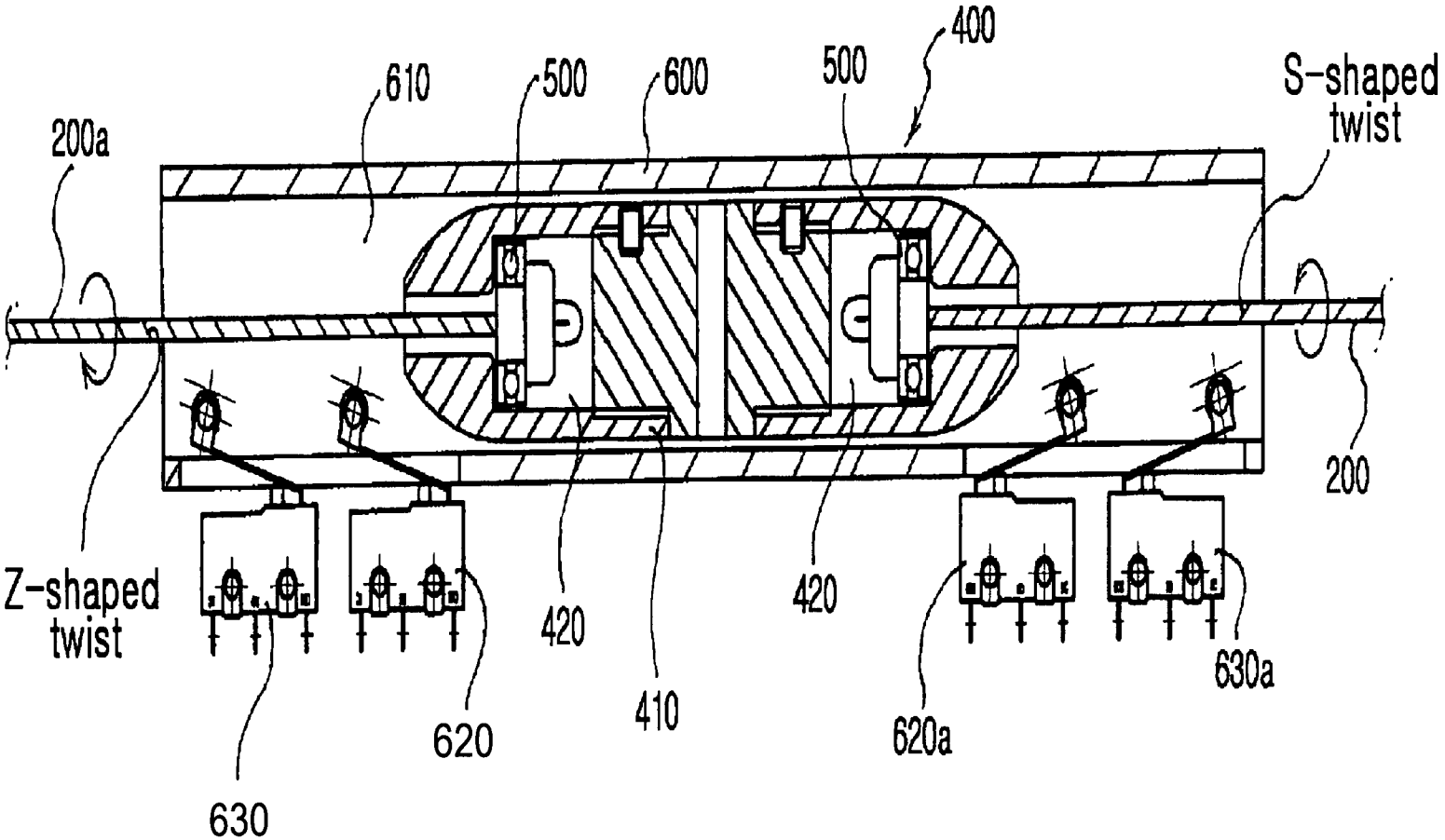

[Fig. 3]
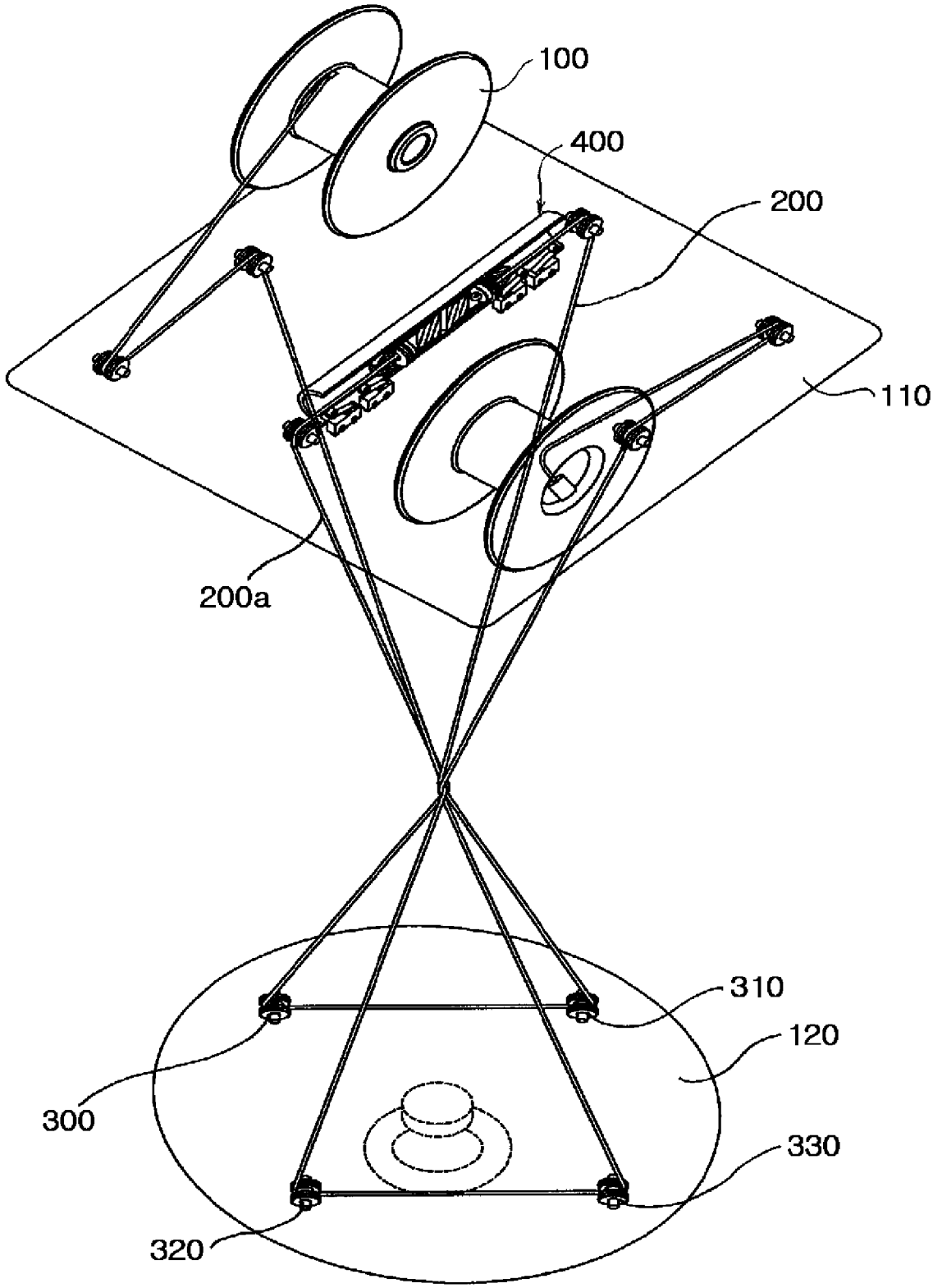

WIRE-TWISTING PREVENTION DEVICE OF LIFTING REEL WITH FOUR-LINE WIRE STRUCTURE AND LIFTING REEL HAVING THE SAME

TECHNICAL FIELD

The present invention relates to a wire-twisting prevention device of a lifting reel with a four-line wire structure, and more particularly to a wire-twisting prevention device of a lifting reel with a four-line wire structure in which the wire-twisting prevention device is connected between an end of a wire connected to a first drum and an end of a wire connected to a second drum so as to prevent twisting of the wires while the wires are wound around or unwound from the drums and allow the wires to be uniformly wound around the first and second drums.

BACKGROUND ART

Generally, various products moving up and down using a wire have been put into the market. Such products having a lifting function are as follows.

First, a highly-mounted lamp is installed on the ceiling of a building such as a factory or a gymnasium to illuminate the interior of a room. Also, a grill of an air conditioner is positioned to a lower end of a main body fixed to the ceiling and inhales an air in a room so as to discharge a cool or hot air generated in the air conditioner into the room. In addition, a chandelier is installed to the ceiling of a building such as a hotel lobby or a wedding hall to give a deluxe lighting. Also, a batten for lights above the stage is installed to various stages for public performances and used for assembling lights or drop curtain. There are also various kinds of products that are partially or entirely lifted.

The highly-mounted lamp, the grill for an air conditioner, the chandelier and the batten for the stage (hereinafter, referred to as a product), mentioned above, are used in different usages, but they are all installed to the ceiling of a building. Thus, after a long time use, the product is worn due to its life cycle or soiled due to accumulated dirt, so the product needs periodical cleaning or exchange. At this time, in order to facilitate the exchange or cleaning work in a more convenient and easier way, a lifting reel for moving the product down to the ground is installed to the product.

Such a lifting reel may have a one-line wire structure, a two-line wire structure or a four-line wire structure. Among them, the lifting reel with a four-wire structure, a subject of the present invention, will be explained in brief based on its configuration. The lifting reel with a four-wire structure includes a fixed body fixed to a ceiling of a structure, first and second drums installed in the fixed body to be spaced apart from each other by a predetermined distance and rotated by a driving motor, a wire having one end connected to the first drum and the other end connected to the second drum, and first, second, third and fourth guide rollers arranged to a top of a lifting body at certain intervals and suspended on the wire.

The conventional lifting reel with a four-line wire structure may move an article up and down by rotating the first and second drums. This wire is commonly connected to the first and second drums in one line. In addition, the wire is generally twisted in a "S" or "Z" shape to enhance its strength, so the wire tends to rotate in its twisted direction by itself when being wound around or unwound from the drum.

Thus, since the wire rotates by itself in its twisted direction while being wound around or unwound from the drum, the four-line wire may be tangled, and the tangled wire should be untangled by hands one by one, so cumbersomely.

DISCLOSURE OF INVENTION

Technical Problem

The present invention is designed in consideration of the above problems, and therefore it is an object of the invention to provide a wire-twisting prevention device of a lifting reel with a four-line wire structure, wherein the wire-twisting prevention device is installed between an end of a wire connected to a first drum and an end of a wire connected to a second drum such that, if the wires rotate by themselves in their twisted directions while being wound around or unwound from the drums, the wire-twisting prevention device may release the twisted state.

Another object of the present invention is to provide a wire-twisting prevention device of a lifting reel with a four-line wire structure, which allows a wire to be wound uniformly in a way that, if the wire is wound more around any one of the first and second drums, the wire-twisting prevention device slowly operates the drum around which the wire is wound more.

Technical Solution

In order to accomplish the above object, the present invention provides a wire-twisting prevention device of a lifting reel with a four-line wire structure, which includes a fixed body fixed to a ceiling of a structure, first and second drums installed to the body at a predetermined interval and rotated by a driving motor, wires respectively connected to the first and second drums, and first, second, third and fourth guide rollers arranged on a top of a lifting body at regular intervals and suspended on the wires to form a four-line wire, wherein the wire-twisting prevention device is installed between an end of the wire connected to the first drum and an end of the wire connected to the second drum so as to connect both wires with each other, wherein the wire-twisting prevention device includes bearings installed to the ends of the wires to be rotatable, respectively, wherein the bearings prevent the wires from being twisted while the wires are wound around or unwound from the drums.

Preferably, the wire-twisting prevention device further includes a guide tube having a predetermined length and having a moving space formed therein; a body inserted into the guide tube to be movable along the guide tube; and slow sensors respectively installed to both sides of the guide tube to be spaced apart from the body by a predetermined distance, wherein the slow sensors detect that the body moves in one direction, and then the slow sensors make a drum, to which the body approaches, be operated slowly.

Preferably, the wire-twisting prevention device further includes stop sensors formed in the guide tube at outer positions of the slow sensors to be spaced apart from the slow sensors by a predetermined length, wherein the stop sensors detect that the body comes in contact thereto, and then the stop sensors make a drum, to which the body approaches, be stopped.

Preferably, rotating spaces are formed in both sides of an inside of the body respectively, and the bearings are rotatably installed in the rotating areas while being coupled to the ends of the wires.

Preferably, the wires connected to the first and second drums have a S-shaped twist and a Z-shaped twist respectively, or vice versa, whereby the wires are twisted in opposite directions.

In another aspect of the present invention, there is also provided a lifting reel with a four-line wire structure, which is provided with the above wire-twisting prevention device.

BRIEF DESCRIPTION OF THE DRAWINGS

FIG. 1 is a perspective view showing essential parts of a lifting reel with a four-line wire structure, which is provided with a wire-twisting prevention device according to the present invention.

FIG. 2 is a sectional view showing the wire-twisting prevention device of a lifting reel with a four-line wire structure according to the present invention.

FIG. 3 is a perspective view showing that the four-line wire of the lifting reel with a four-line wire structure is tangled.

REFERENCE NUMERALS OF ESSENTIAL PARTS IN THE DRAWINGS

100, 100*a*: drum 200, 200*a*: wire
300: first guide roller 310: second guide roller
320: third guide roller 330: fourth guide roller
400: wire-twisting prevention device 410: body
420: rotating space 500: bearing
600: guide tube 610: moving space
620, 620*a*: slow sensor 630, 630*a*: stop sensor

BEST MODE FOR CARRYING OUT THE INVENTION

Hereinafter, preferred embodiments of the present invention will be described in detail with reference to the accompanying drawings.

FIG. 1 is a perspective view showing essential parts of a lifting reel with a four-line wire structure, which is provided with a wire-twisting prevention device according to the present invention, FIG. 2 is a sectional view showing the wire-twisting prevention device of a lifting reel with a four-line wire structure according to the present invention, and FIG. 3 is a perspective view showing that the four-line wire of the lifting reel with a four-line wire structure is tangled.

The lifting reel with a four-line wire structure, which is provided with the wire-twisting prevention device according to the present invention, includes a fixed body 110 fixed to a ceiling of a structure, first and second drums 100, 100*a* installed in the fixed body 110 at a predetermined interval and rotated by a driving motor (not shown), wires 200, 200*a* connected to the first and second drums 100, 100*a*, and first, second, third and fourth guide rollers 300, 310, 320, 330 arranged at the top of a lifting body 120 at regular intervals and suspended on the wires 200, 200*a*. The wires 200, 200*a* are connected via the first, second, third and fourth guide rollers 300, 310, 320, 330 to form a four-line wire.

In addition, to use the lifting reel more effectively, as shown in FIGS. 1 to 3, a wire-twisting prevention device 400 is installed between an end of the wire 200 connected to the first drum 100 and an end of the wire 200*a* connected to the second drum 100*a*. The wire-twisting prevention device 400 makes the wires 200, 200*a* be connected with each other, and also allows the wires 200, 200*a* to be uniformly wound around the first and second drums 100, 100*a* without being tangled while the wires 200, 200*a* are wound around or unwound from the drums.

The wire-twisting prevention device 400 is provided with a guide tube 600 with a predetermined length. A moving space 610 is formed inside the guide tube 600. In addition, a body 410 is inserted into the guide tube 600 to be movable in the guide tube 600 along the guide tube 600. Rotating spaces 420 are formed inside both sides of an inside of the body 410, and the rotating spaces 420 give a space in which ends of the wires 200, 200*a* may rotate. Bearings 500 are respectively installed to the ends of the first and second wires 200, 200*a* connected to the first and second drums 100, 100*a*. The bearings 500 are positioned inside the rotating spaces 420 while being connected to the ends of the wires 200, 200*a*. These bearings 500 make the wires 200, 200*a* rotate in a twisted direction of the wires while the wires 200, 200*a* are unwound from or wound around the drums, thereby playing a role of preventing the wires from twisting. Slow sensors 620, 620*a* are respectively mounted to both sides of a lower end of the guide tube 600 to be spaced apart from the body 410 by a predetermined length. If the body 410 moves right or left, the slow sensors 620, 620*a* detect it and then slowly operate a drum to which the body 410 approaches. Stop sensors 630, 630*a* are mounted at outer positions of the slow sensors 620, 620*a* to be spaced apart from the slow sensors 620, 620*a* by a predetermined length. When the body 410 comes in contact with any of the stop sensors 630, 630*a*, the stop sensor 630, 630*a* detects it and then stops a drum to which the body 410 approaches.

Now, the wire used in the lifting reel with a four-line wire structure according to the present invention will be explained in brief. The wire 200, 200*a* commonly adopts a wire that is twisted in a "S" or "Z" shape. In the present invention, the wire 200 connected to the first drum 100 has a S-shaped twist, while the wire 200*a* connected to the second drum 100*a* has a Z-shaped twist, as an example. That is to say, in the present invention, the wires 200, 200*a* are selected to have opposite twists.

While it is negligible when the wires 200, 200*a* are unwound just shortly, each of the wires 200, 200*a* tends to rotate by itself in its own twisted direction when it is unwound long. At this time, the wire 200 connected to the first drum 100 and the first and second guide rollers 300, 310 tends to rotate left, while the wire 200*a* connected to the second drum 100*a* and the third and fourth guide rollers 320, 330 tends to rotate right. Thus, the rotating of the wires 200, 200*a* offset each other, and the four-line wire of the present invention will not be tangled.

If both of the first and second drums 100, 100*a* have only one kind of twist, namely only the S-shaped twist or the Z-shaped twist, the four-line wire tends to rotate in the same direction, namely in a right or left direction, so the four-line wire is tangled as shown in FIG. 3.

Here, the bearings 500 allowing the wires 200, 200*a* to rotate by themselves in their twisted directions are preferably a trust bearing. However, the present invention is not limited thereto, but another kind of bearing or bushing may also be used if it may help the wires 200, 200*a* to rotate by themselves in their twisted directions.

In order to use the wire-twisting prevention device configured as above according to the present invention, first, the wire 200 having a S-shaped twist is connected to the first drum 100, and the wire 200*a* having a Z-shaped twist is connected to the second drum 100*a*. Then, the bearings 500 are coupled to ends of the wires 200, 200*a*, and then the bearings 500 are positioned inside the rotating spaces 420 formed at both sides of the body 410.

After that, the body 410 is inserted into the moving space 610 formed inside the guide tube 600 such that the body 410 is positioned between the slow sensors 620, 620*a*. At this time, the wire 200 connected to the first drum 100 passes via the first and second guide rollers 300, 310, and the wire 200*a* connected to the second drum 100*a* passes via the third and fourth guide rollers 320, 330.

When the wires 200, 200*a* are wound around or unwound from the drums in this state, the wires tend to rotate by themselves in their own twisted directions. At this time, the bearings 500 integrally connected to the ends of the wires 200, 200*a* rotate in the twisted direction of the wire inside the rotating spaces 420 to conform to the rotation of the wires themselves. Thus, the wires 200, 200*a* do not rotate by themselves. In addition, since the wires 200, 200*a* are twisted in different directions, the four-line wire is not tangled even after the lifting body 120 is descended.

Meanwhile, when the wires 200, 200*a* are wound around the drums, any one of the wires may be more wound around one drum due to an outer diameter of the drum or other external conditions (for example, the wires may be leaned one side without being uniformly wound around the drums). In this case, the body 410 and the slow sensors 620, 620*a* may work together such that the wires 200, 200*a* may be uniformly wound around the first and second drums 100, 100*a*. It is now explained in more detail.

When the wires 200, 200*a* are wound uniformly around the first and second drums 100, 100*a*, the body 410 is positioned at the middle of the moving space 610 of the guide tube 600. In this state, if the wire is wound more around the first drum 100, the body 410 is pulled right on the drawing along the wire 200 and thus moves toward the slow sensor 620*a*. If the body 410 comes in contact with the slow sensor 620*a* while moving right, the slow sensor 620*a* detects the body 410 and then controls a driving motor where the wire 200 is wound more (namely, the driving motor connected to the first drum 100) such that the first drum 100 is operated slowly.

If the first drum 100 is operated slowly, the wire 200*a* connected to the second drum 100*a* is wound more than the wire 200 connected to the first drum 100, so the body 410 is slowly moved left on the drawing. If the contact between the body 410 and the slow sensor 620*a* is released, namely if the body 410 is positioned again at the middle of the guide tube 600, the slow sensor 620*a* operates the first drum 100 normally. Through the above process, the wires 200, 200*a* may be uniformly wound around the first and second drums 100, 100*a*.

If the wire is wound more around the second drum 100*a* oppositely to the above, the body 410 is pulled left on the drawing along the wire 200*a* and thus moves toward the slow sensor 620. If the body 410 comes in contact with the slow sensor 620 while moving left, the slow sensor 620 detects the body 410 and then controls a driving motor where the wire 200*a* is wound more (namely, the driving motor connected to the second drum 100*a*) such that the second drum 100*a* is operated slowly.

If the second drum 100*a* is operated slowly, the wire 200 connected to the first drum 100 is wound more than the wire 200*a* connected to the second drum 100*a*, so the body 410 is slowly moved right on the drawing. At this time, if the contact between the body 410 and the slow sensor 620 is released, namely if the body 410 is positioned again at the middle of the guide tube 600, the slow sensor 620 operates the second drum 100*a* normally. Through the above process, the wires 200, 200*a* are uniformly wound around the first and second drums 100, 100*a*.

Meanwhile, if the body 410 is abruptly moved left on the drawings and thus comes in contact with the stop sensor 630, the stop sensor 630 stops the second drum 100*a*. Meanwhile, if the body 410 is abruptly moved right on the drawings and thus comes in contact with the stop sensor 630*a*, the stop sensor 630*a* stops the first drum 100. Through this process, the wires may be uniformly wound around the first and second drums.

INDUSTRIAL APPLICABILITY

As described above, the wire-twisting prevention device of the present invention is installed between an end of a wire connected to a first drum and an end of a wire connected to a second drum. Thus, though the wires rotate by themselves in their twisted directions, the wire-twisting prevention device looses the rotation, thereby fundamentally preventing twisting of the wires.

In addition, the wire connected to the first drum is twisted in an opposite direction to the wire connected to the second drum. Thus, though the wires are unwound long, the wires tend to rotate opposite directions, so the four-line wire is not tangled.

In addition, if any wire is wound more around any one of the first and second drums, the slow sensor detects it and then slowly operates a drum on which the wire is wound more, so the wires may be uniformly wound around the first and second drums.

The invention claimed is:

1. A wire-twisting prevention device of a lifting reel with a four-line wire structure, the device comprising:

a fixed body fixed to a ceiling of a structure;

first and second drums installed to the body at a predetermined interval and rotated by a driving motor;

wires respectively connected to the first and second drums; and first, second, third and fourth guide rollers arranged on a top of a lifting body at regular intervals and suspended on the wires to form a four-line wire;

a guide tube having a predetermined length and having a moving space formed therein;

a body inserted into the guide tube to be movable along the guide tube; and slow sensors respectively installed to both sides of the guide tube to be spaced apart from the body by a predetermined distance, wherein the slow sensors detect that the body moves in one direction, and then the slow sensors make a drum, to which the body approaches, be operated slowly;

wherein the wire-twisting prevention device is installed between an end of the wire connected to the first drum and an end of the wire connected to the second drum so as to connect both wires with each other;

wherein the wire-twisting prevention device includes bearings installed to the ends of the wires to be rotatable, respectively;

wherein the bearings prevent the wires from being twisted while the wires are wound around or unwound from the drums.

2. The wire-twisting prevention device of a lifting reel with a four-line wire structure according to claim 1, further comprising:

stop sensors formed in the guide tube at outer positions of the slow sensors to be spaced apart from the slow sensors by a predetermined length, wherein the stop sensors detect that the body comes in contact thereto, and then the stop sensors make a drum, to which the body approaches, be stopped.

3. The wire-twisting prevention device of a lifting reel with a four-line wire structure according to claim 1, wherein rotating spaces are formed in both sides of an inside of the body respectively, and the bearings are rotatably installed in the rotating areas while being coupled to the ends of the wires.

4. The wire-twisting prevention device of a lifting reel with a four-line wire structure according to claim 1, wherein the wires connected to the first and second drums have a S-shaped twist and a Z-shaped twist respectively, or vice versa, whereby the wires are twisted in opposite directions.

5. A lifting reel with a four-line wire structure, comprising:

a fixed body fixed to a ceiling of a structure;

first and second drums installed to the body at a predetermined interval and rotated by a driving motor;

wires connected to the first and second drums respectively;

first, second, third and fourth guide rollers arranged on a top of a lifting body and suspended on the wires to form a four-line wire;

a wire-twisting prevention device installed between an end of the wire connected to the first drum and an end of the wire connected to the second drum so as to connect the wires with each other;

a guide tube having a predetermined length and having a moving space formed therein;

a body inserted into the guide tube to be movable along the guide tube; and slow sensors respectively installed to both sides of the guide tube to be spaced apart from the body by a predetermined length, wherein the slow sensors detect that the body is moved in one direction, and then the slow sensors make a drum, to which the body approaches, be operated slowly;

wherein the wire-twisting prevention device includes bearings respectively installed to the ends of the wires, and wherein the bearings prevent the wires from being twisted while the wires are wound around or unwound from the drums.

6. The lifting reel with a four-line wire structure according to claim 5, wherein the wire-twisting prevention device further includes stop sensors formed in the guide tube at outer positions of the slow sensors to be spaced apart from the slow sensors by a predetermined length, wherein the stop sensors detect that the body comes in contact thereto, and then the stop sensors make a drum, to which the body approaches, be stopped.

7. The lifting reel with a four-line wire structure according to claim 5, wherein rotating spaces are formed in both sides of an inside of the body respectively, and the bearings are rotatably installed in the rotating areas while being coupled to the ends of the wires.

8. The lifting reel with a four-line wire structure according to claim 5, wherein the wires connected to the first and second drums have a S-shaped twist and a Z-shaped twist respectively, or vice versa, whereby the wires are twisted in opposite directions.

* * * * *